US007120270B2

(12) United States Patent
Aronson et al.

(10) Patent No.: US 7,120,270 B2
(45) Date of Patent: Oct. 10, 2006

(54) AUDIO DEVICE HEAT TRANSFERRING

(75) Inventors: Scott H. Aronson, Grafton, MA (US); Damian Howard, South Boston, MA (US); Craig A. Liebel, Framingham, MA (US); Richard Warren Little, Somerville, MA (US); John Schussler, Worcester, MA (US); Lee J. Shumosic, Norton, MA (US); Bradford Kyle Subat, Worcester, MA (US)

(73) Assignee: Bose Corporation, Framingham, MA (US)

( * ) Notice: Subject to any disclaimer, the term of this patent is extended or adjusted under 35 U.S.C. 154(b) by 835 days.

(21) Appl. No.: 10/246,331

(22) Filed: Sep. 18, 2002

(65) Prior Publication Data

US 2004/0052397 A1 Mar. 18, 2004

(51) Int. Cl.
*H04R 1/02* (2006.01)

(52) U.S. Cl. ..... 381/397; 381/412; 381/416

(58) Field of Classification Search ..... 381/397, 381/398, 400, 403, 404, 412, 416, 420, 432, 381/86, 386, 389, 396; 310/12–15, 17, 190; 29/594, 609.1

See application file for complete search history.

(56) References Cited

U.S. PATENT DOCUMENTS

| | | | | |
|---|---|---|---|---|
| 2,030,648 | A | 2/1936 | Alexander | |
| 4,625,328 | A | 11/1986 | Freadman et al. | |
| 5,475,765 | A * | 12/1995 | Lyth | 381/433 |
| 6,243,472 | B1 | 6/2001 | Bilan et al. | |
| 7,016,514 | B1 * | 3/2006 | White et al. | 381/397 |

FOREIGN PATENT DOCUMENTS

| | | |
|---|---|---|
| FR | 2803132 | 6/2001 |
| GB | 2 360 899 A | 10/2001 |
| JP | 57 192200 A | 2/1983 |
| JP | 2001136032 | 5/2001 |

OTHER PUBLICATIONS

S. Gerken. European Patent Examination Report, Apr. 6, 2006.

* cited by examiner

*Primary Examiner*—Huyen Le
(74) *Attorney, Agent, or Firm*—Fish & Richardson P.C.

(57) ABSTRACT

An acoustic device having a heat producing device, such as an amplifier and a heat sink for transferring heat from the amplifier. The acoustic device has a cone having an inner surface, and a support structure defining a volume. The heat producing element and the heat sink are positioned in the volume.

10 Claims, 9 Drawing Sheets

AUDIO DEVICE HEAT TRANSFERRING

TECHNICAL FIELD

The invention relates to heat removal from audio devices, and more particularly to a device using air motion generated by an acoustic driver to transfer heat generated by audio amplifiers.

BACKGROUND OF THE INVENTION

It is an important object of the invention to provide an audio device having improved heat transfer capabilities.

BRIEF SUMMARY OF THE INVENTION

According to the invention, an acoustic device, comprises an acoustic driver, including a frustal shaped vibratile surface defining a frustal shaped volume. The vibratile surface has an inner side and an outer side. The frustal shaped volume is characterized by an axis. A support structure is mechanically coupled to the vibratile surface, extending axially from the inner side. The support structure defines a second volume. The second volume is contiguous to the frustal shaped volume. The frustal shaped volume and the second volume form an inner volume. An oscillatory motor device, coupled to the vibratile surface, causes the vibratile surface to vibrate in an axial direction, causing air movement in the inner volume. The acoustic device further includes a heat producing device, distinct from the oscillatory motor device, mounted so that a substantial portion of the heat producing device is in the inner volume.

In another aspect of the invention, a loudspeaker device is for mounting in a door of a vehicle. The door has a passenger compartment facing side and an exterior facing side. The loudspeaker device includes an acoustic driver. The acoustic driver includes a vibratile pressure wave radiating surface and an amplifier, for amplifying an audio signal for transducing by the acoustic driver. The radiating surface is positioned so that the radiating surface is between the amplifier assembly and the exterior facing side.

In still another aspect of the invention, an acoustic device comprises an acoustic driver. The acoustic driver, comprises a frustal shaped vibratile surface defining a frustal shaped volume. The vibratile surface has an inner side and an outer side. The frustal shaped volume is characterized by an axis. A support structure is mechanically coupled to the vibratile surface, and extends axially from the inner side, defining a second volume. The second volume is contiguous to the frustal shaped volume. The frustal shaped volume and the second volume form an inner volume. The acoustic device further includes an oscillatory motor device, coupled to the vibratile surface, for causing the vibratile surface to vibrate in an axial direction. The vibration causes air movement in the inner volume. The acoustic device also includes a heat producing device, distinct from the oscillatory motor device and a heat sink, thermally coupled to the heat producing device, for transferring heat from the heat producing device. The acoustic driver, the heat producing device and the heat sink are constructed and arranged so that a substantial portion of the heat sink is in the inner volume.

Other features, objects, and advantages will become apparent from the following detailed description, when read in connection with the accompanying drawing in which:

DETAILED DESCRIPTION

Figure 1A:
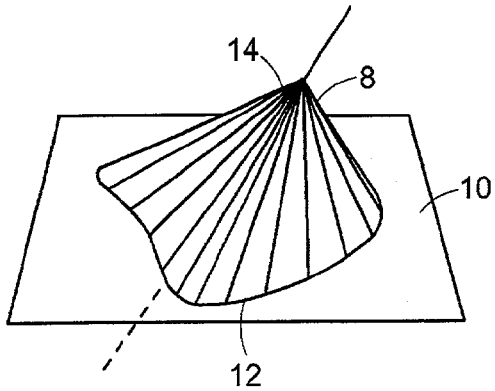
FIGS. 1*a*–1*d* are views of geometric figures and a diagrammatic view of an acoustic driver for explaining some terms used herein.
Figure 1B:
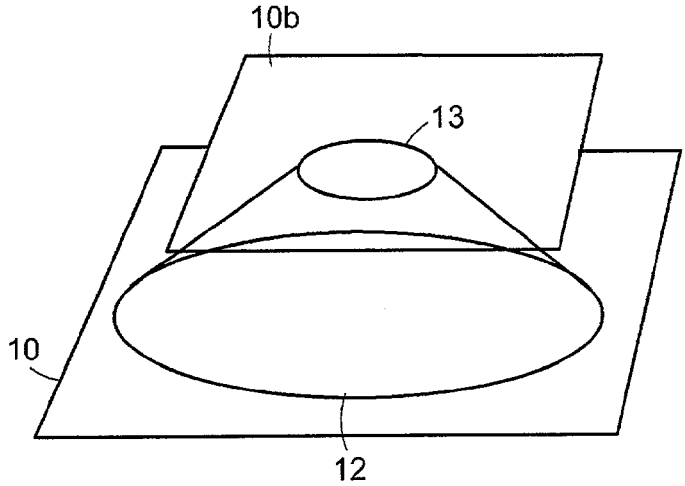
Figure 1C:
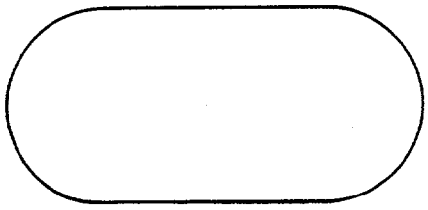
Figure 1D:
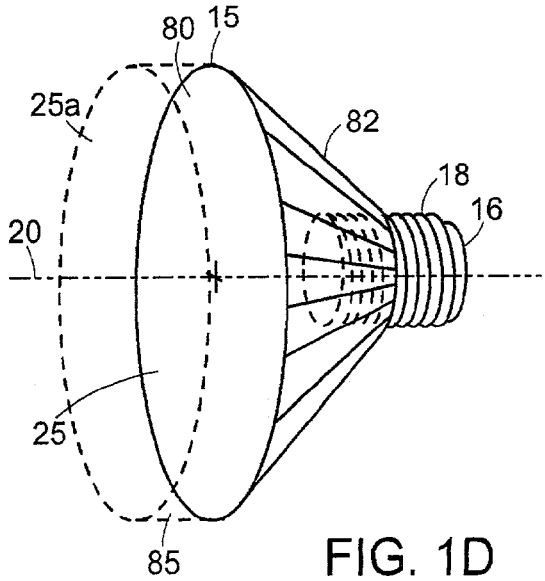

With reference now to the drawing and more particularly to FIGS. 1*a*–1*d*, there are shown some geometric figures for explaining some of the terms used below. A cone 8, (or cone surface), as used herein, shown in FIG. 1*a* is a surface generated by a line, typically straight, which moves so that it always intersects a closed plane curve, called the directrix 12, and passes through a point 14, called the vertex, not in the plane 10 of the directrix 12. The generating line in each of its position is referred to as an element. A frustum, shown in FIG. 1*b*, is a solid figure bounded by a portion of plane 10 bounded by the directrix 12, the cone, and a portion of a second plane 10*b* parallel to plane 10. The portion of plane 10*b* that bounds the frustum is the closed curve formed by the intersection 13 of cone 8 with the plane 10*b*. As used herein, a frustal shaped surface refers to the surface of a frustum defined by the cone. A frustal shaped volume refers to the volume bounded by the frustal shaped surface and the two planes 10 and 10*b*, or in other words the volume occupied by the frustum corresponding to the frustal shaped surface. The directrix and the intersection 13 of the cone and second plane 10*b* may be a circle, and may also be some shape other than a circle, such as oval or a figure defined by two semicircles joined by straight lines as shown in FIG. 1*c*, frequently described as a "racetrack." Preferably, the frustum bounded by the frustal shaped surface is a right frustum, that is, a frustum in which the axis (a line passing through the vertex and the centers of the areas bounded by the closed curves in planes 10 and 10*b*) is perpendicular to planes 10 and 10*b*.

FIG. 1 d shows the radiating surface 15 of an acoustic driver in the form of a right frustal shaped surface, with an axis 20. The radiating surface has two sides 80 and 82. One side 80, hereinafter the inner side, is the side that faces the frustal shaped volume 25. The second side 82, hereinafter the outer side, is the side that faces away from the frustal shaped volume. Typically, a portion of an oscillatory motor, such as a coil former 16 wrapped with a coil 18, is mechanically coupled to the radiating surface. A portion 85 of a support structure may extend in an axial direction from the inner side of the radiating surface in such a manner as to enclose a volume 25*a* contiguous to the frustal shaped volume. The volume consisting of the frustal shaped volume 25 and the contiguous volume 25*a* will hereinafter be referred to as the inner volume. In some implementations, the frame member may not extend axially from the inner side of the radiating surface, so that the contiguous volume is essentially zero and the inner volume is substantially coincident with the frustal shaped volume 25. The support structure 88 will be described in more detail in subsequent views. In some implementations, the motor structure may be positioned on the inner side of the radiating surface, as indicated by the dashed lined.

Figure 2A:
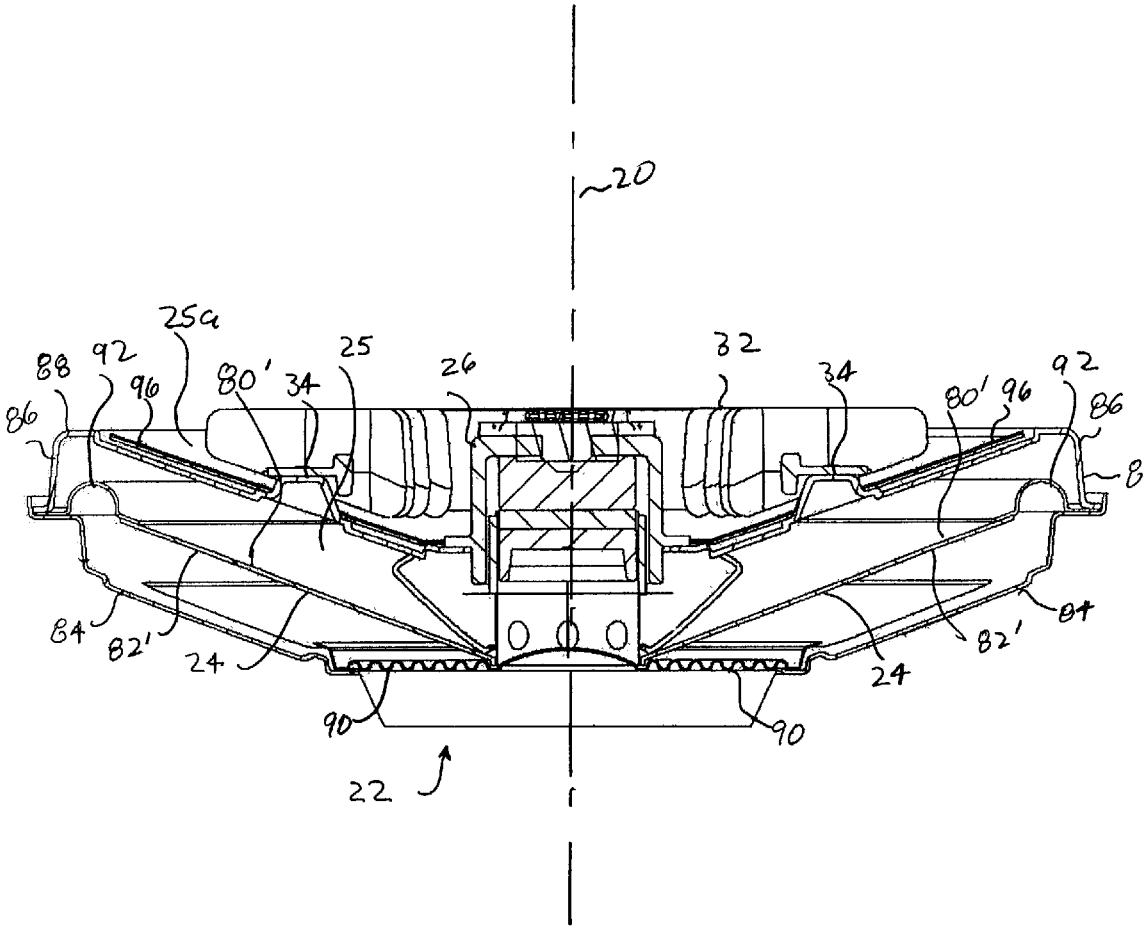
FIGS. 2*a*–2*c* are views of an embodiment of the invention.
Figure 2B:
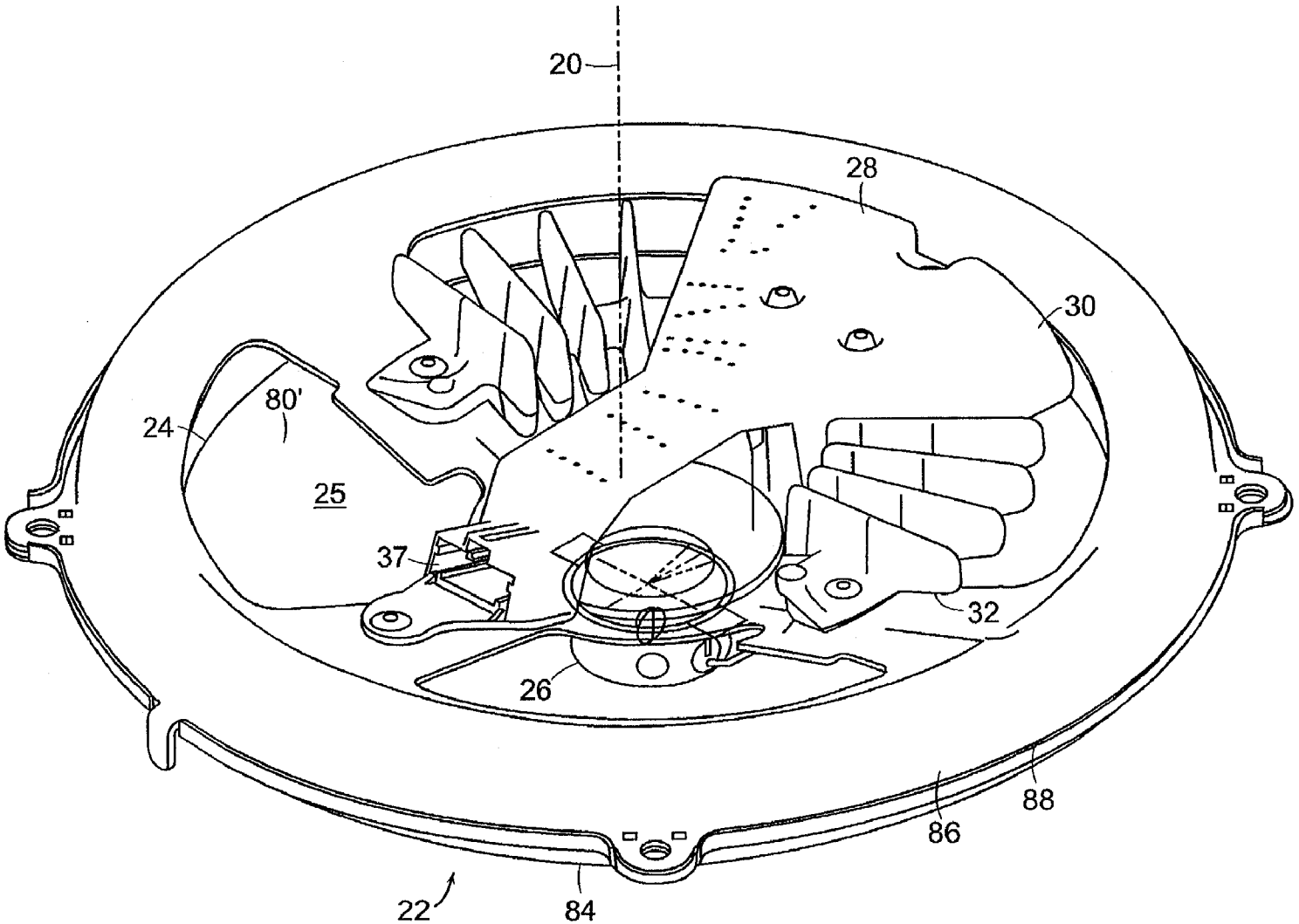
Figure 2C:
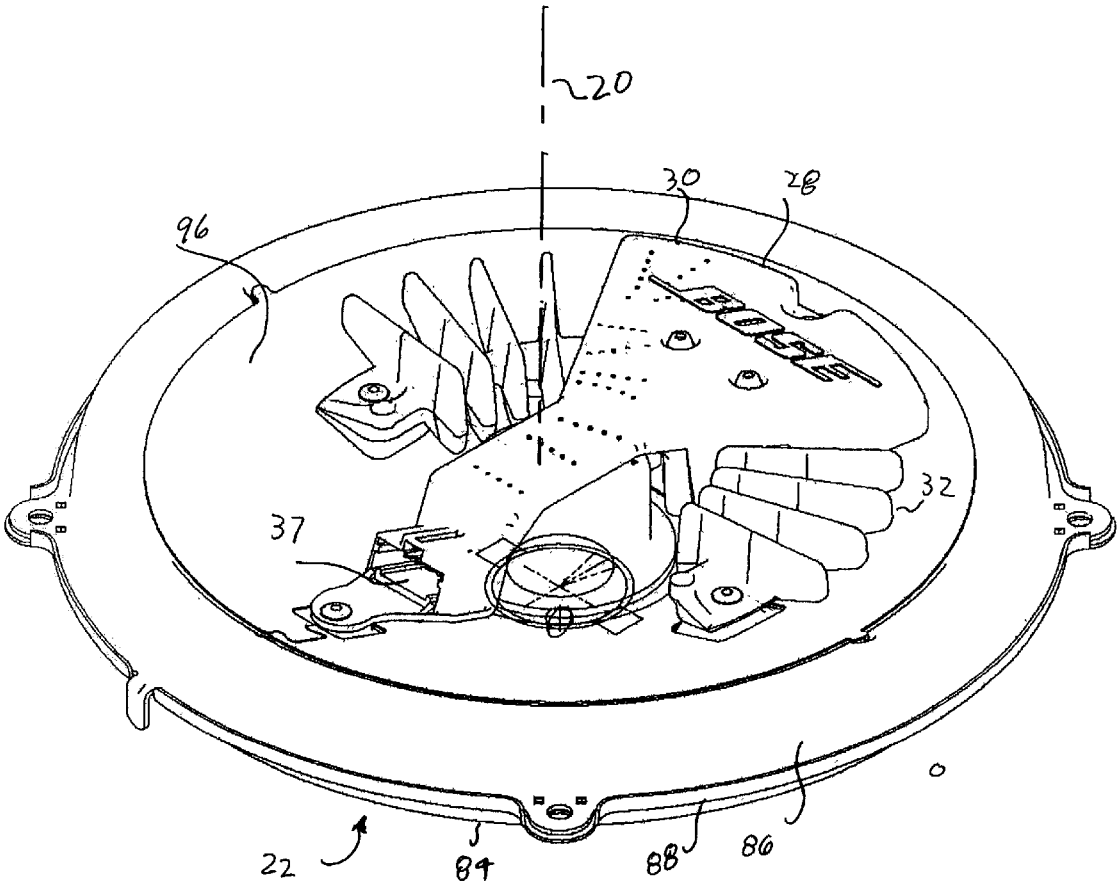

Referring now to FIGS. 2*a*–2*c*, there are shown, respectively, a cross-sectional view, an isometric view, and an isometric view with an element removed to show details, of an embodiment of an acoustic driver according to the invention. An acoustic driver 22 includes a driver cone 24 that is in the form of a frustal shaped surface. Driver cone 24 encloses a frustal shaped volume 25. In this embodiment, oscillatory motor structure 26 is in the frustal shaped volume. The inner side 80' of the driver cone 24 faces frustal shaped volume 25. The outer side 82' of the driver cone 24 faces away from the frustal shaped volume. A support structure 88 includes a basket portion 84 and a frame portion 86. A portion of the support structure 88, such as frame portion 86 may extend axially away from the inner side of the driver cone 24 so as to enclose a volume 25*a* contiguous to frustal shaped volume 25. The combined volumes 25 and 25*a* comprise the inner volume. As stated above, in other implementations, the frame portion 86 may not extend axially, so that the inner volume is substantially coincident with the frustal shaped volume. Coupling the driver cone 24 to the support structure 88 may be a spider 90 and a surround 92.

On the inner side of the driver cone 24, in the inner volume (combined volumes 25 and 25*a*) may be scrim layer 96. The scrim layer, which has been removed in FIG. 3*c*, is a layer of a low acoustic resistance (ideally acoustically transparent) material, which protects the driver cone 24.

The amplifier assembly 28 includes an amplifier cover 30, which holds an amplifier (not shown) in thermal contact with a heat sink 32, which will be described in more detail below. Amplifier assembly 28 is secured to the supporting structure of the acoustic driver 22 by an attachment assembly having fastener receptacles 34 which protrude through openings 36 in the scrim layer 96. Fastener receptacles 34 accommodate fasteners, not shown, to hold the amplifier assembly in place. Connector receptacle 37 accommodates a connector, not shown, which transmits audio signals and electrical power to the amplifier assembly.

Amplifier assembly 28 is positioned so that a substantial portion, preferably all, of the amplifier assembly is in the inner volume.

In operation, the motion of the oscillatory motor causes the cone portion of the acoustic driver to vibrate in an axial direction and to radiate pressure waves, which, at audible frequencies, are sound waves. In radiating the pressure waves, the vibration of the vibratile surface causes air motion in the inner volume, in which the amplifier assembly is positioned. The air motion facilitates heat transfer from the amplifier assembly.

In one embodiment, the acoustic driver is an ND® Woofer manufactured by Bose Corporation of Framingham, Mass., U.S.A. The amplifier may be a conventional linear or switching amplifier. Cone surface 24' may be made of treated paper.

Figure 3:
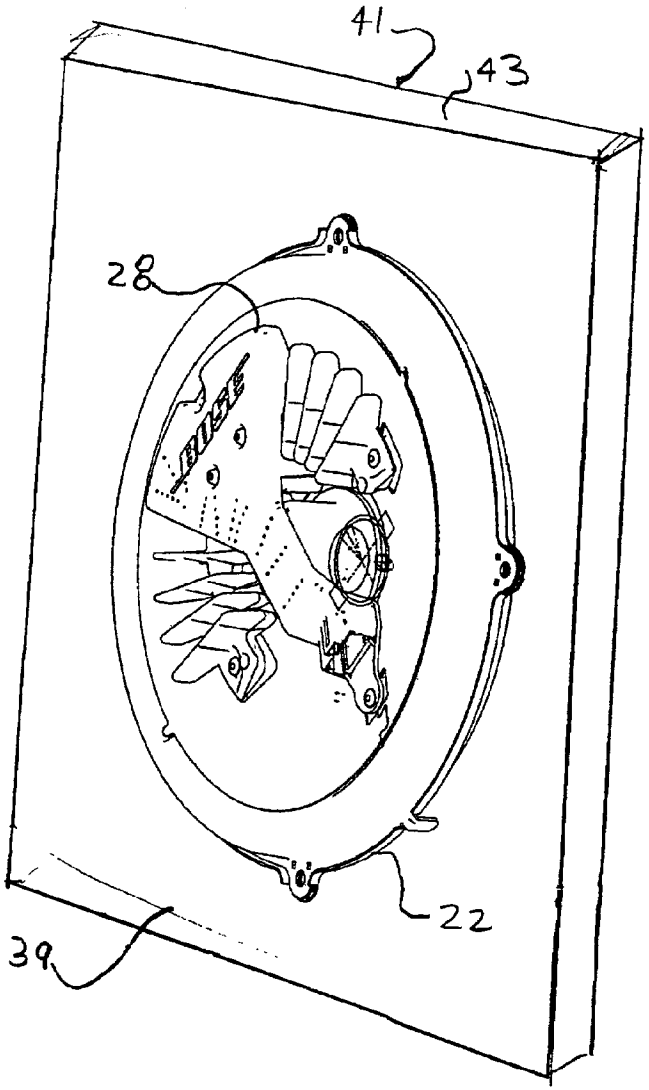
FIG. 3 is a view of an embodiment of the invention mounted in a vehicle door.

One of the uses contemplated, shown in FIG. 3, for an audio device according to the invention is mounting the assembly in a car door so that it protrudes through the trim 43 so that the amplifier assembly 28 is between the driver cone surface 24 and the passenger compartment (that is, the listening area) facing side 39 of the door, or, stated differently, the audio device is positioned so that the amplifier assembly is between the driver cone surface and the listening area. Typically, the portion of the audio device protruding through the trim 43 is covered by a protective grille, not shown in this view.

Figure 4:
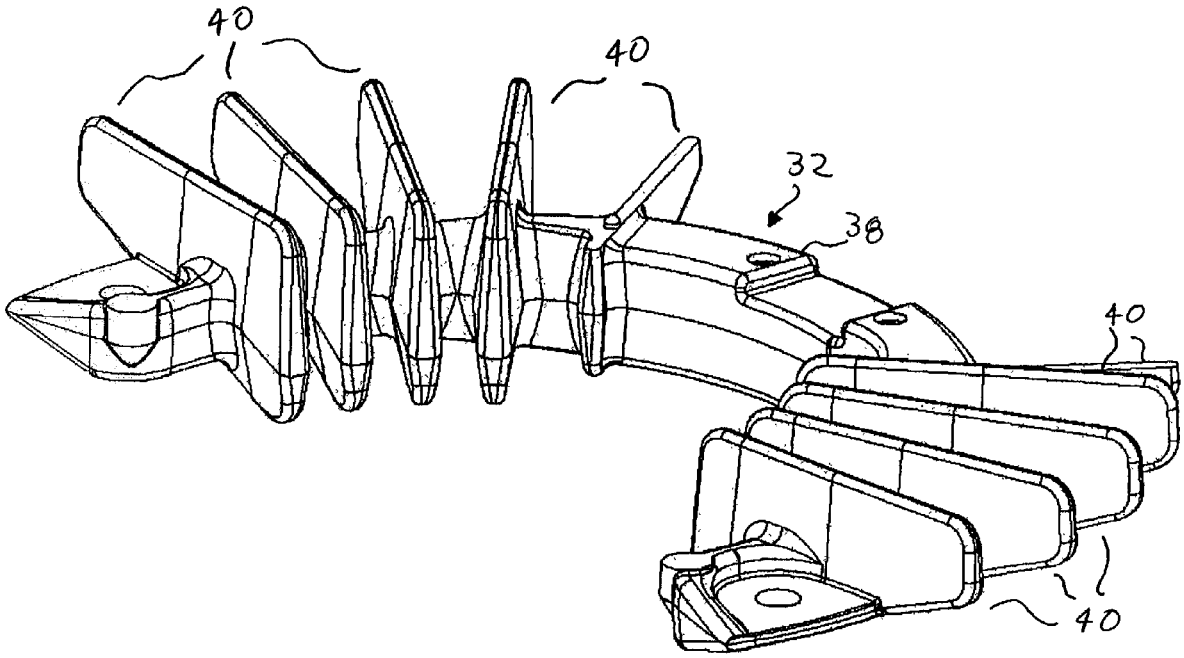
FIG. 4 is a view of a heat sink according to the invention.

A loudspeaker device according to the invention has many advantages over conventional loudspeaker devices, particularly for mounting in vehicle doors, which are relatively narrow in the direction of cone motion. The inner volume, which is unused in conventional loudspeaker devices, is used for components that may otherwise cause the loudspeaker device to be larger in the direction of cone motion. The heat transfer elements are in a location in which there is significant air motion caused by the cone motion. The air motion facilitates heat transfer. Additionally, transmitting more power to the amplifier causes more cone motion, resulting in more air motion and greater heat transfer capacity to accommodate the greater heat transfer requirement for higher power levels. The cone surface provides protection for the amplifier assembly from water and other environmental elements Referring to FIG. 4, there is shown heat sink 32. Heat sink 32 includes a spine member 38 and fins 40. In operation heat is conducted through spine member 38 to fins 40, which have large surfaces to facilitate the transfer of heat to the external environment.

Figure 5:
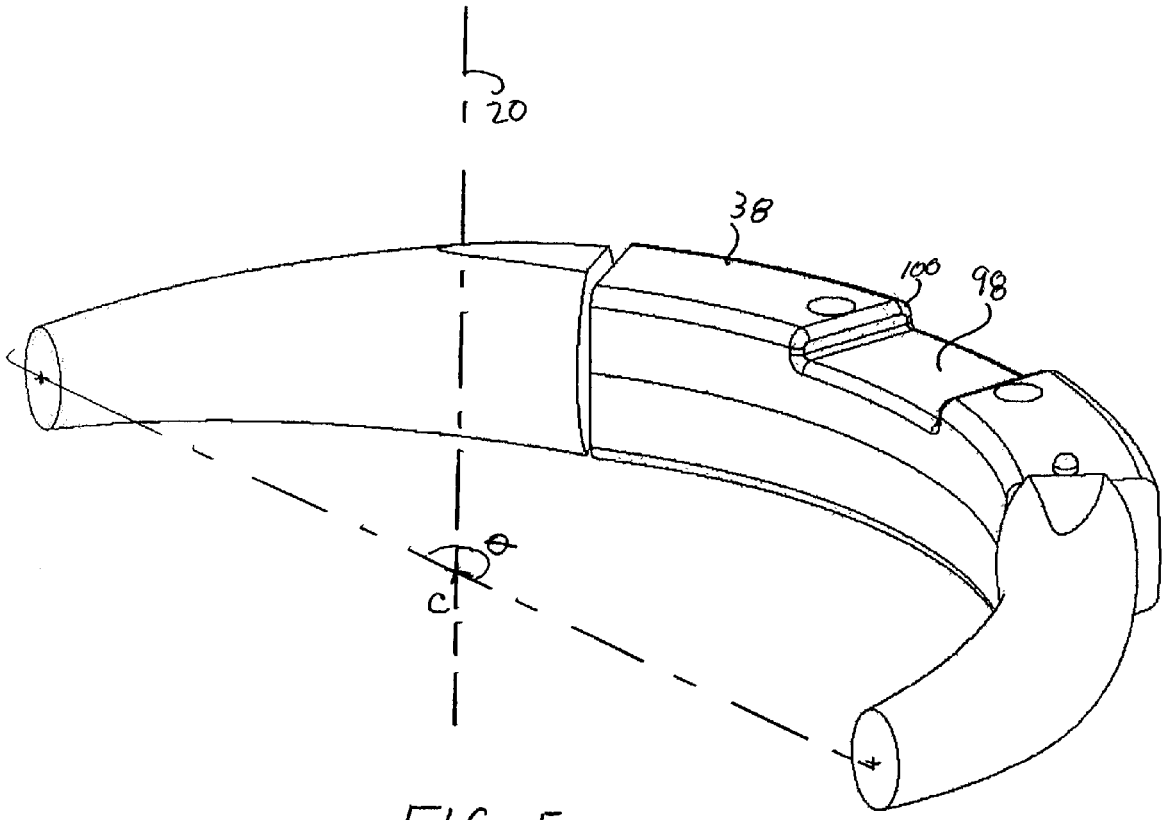
FIG. 5 is a view of the spine of the heat sink of FIG. 4.

FIG. 5 shows spine member 38. Spine member 38 is a metal (or other highly thermally conductive material) piece. The spine member may be in the form of an arc of a circle, and may be positioned such that the center C of the circle is coaxial with axis 20 of FIGS. 1*d* and 2*a*–2*c*.

Figure 6:
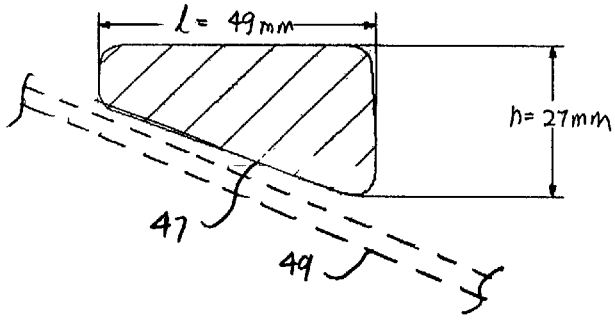
FIG. 6 is a view of one of the fins of the heat sink of FIG. 4.
Figure 6:
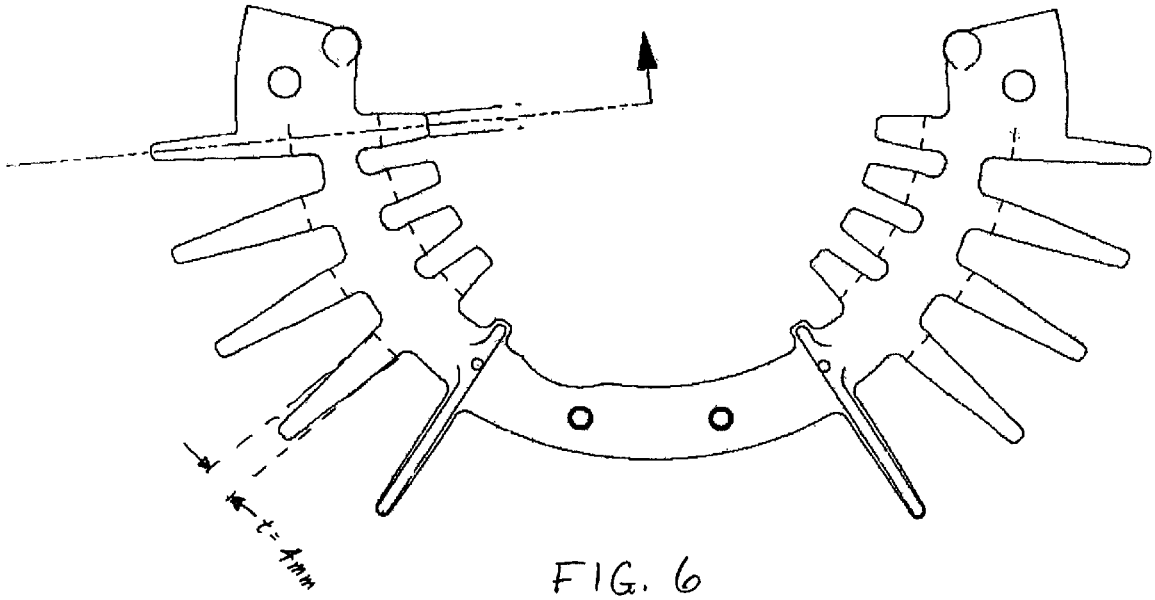

FIG. 6 shows one of the fins 40 in greater detail. The fins are characterized by a height h, a length 1, and a thickness t. The thickness t is substantially less than height h and length l (in one implementation t=approximately 4 mm, h=27 mm, and l=49 mm) so that the fin has a large heat transfer surface including two opposing planar sides 46 to transfer heat. The fins are oriented such the two opposing planar faces are substantially parallel to the spine member, and so that one of the larger dimensions h or l extends in a radial direction relative to the arc of the spine member. The fins may be shaped and positioned so that one edge 47 of the fin is substantially parallel to the cone surface or scrim surface 49. The substantially parallel edge enables more of the fin area to be placed closer to the cone surface, which results in more effective heat transfer.

The configuration and the dimensions of the heat sink may vary depending on the heat transfer requirements. For large heat transfer requirements, the central angle Θ of the arc may be a full 360 degrees so that the arc is a complete circle. For lesser heat transfer requirements, the central angle may be smaller, for example approximately 180 degrees so that the are is substantially a semicircle. The heat sink may be dimensioned and configured so that the thermal contact is concentrated near a point 98 on the spine member 38 that is approximately equidistant between the two extremities, and so that the spine member is tapered so that it is thickest at near the point of thermal contact and thinner at the extremities than at other points of the spine member. If the motor structure 26 requires heat sinking, the heat sink may be configured so that the heat sink is in thermal contact with the motor structure. If the motor structure does not require heat sinking, the heat sink may be configured so that no part of it is close enough to the motor structure to heat the motor structure appreciably. The spine may be at any radial location, such as near the center of the arc, at an intermediate radial distance as in this example, or at a point near the frame portion 86.

In one implementation, the spine member is arcuate about a center that is coaxial with axis 20. The central angle of the arc is approximately 180 degrees, and the radius of the arc is about 55 mm. The spine member is tapered so that it has a cross section of about 183 $mm^2$ at the thickest point 100 near the middle of the spine member in the middle and has a cross section of about 48.4 $mm^2$ at the extremities. The heat sink assembly includes eight or ten fins having a surface area of up to about 900 $mm^2$.

Figure 7:
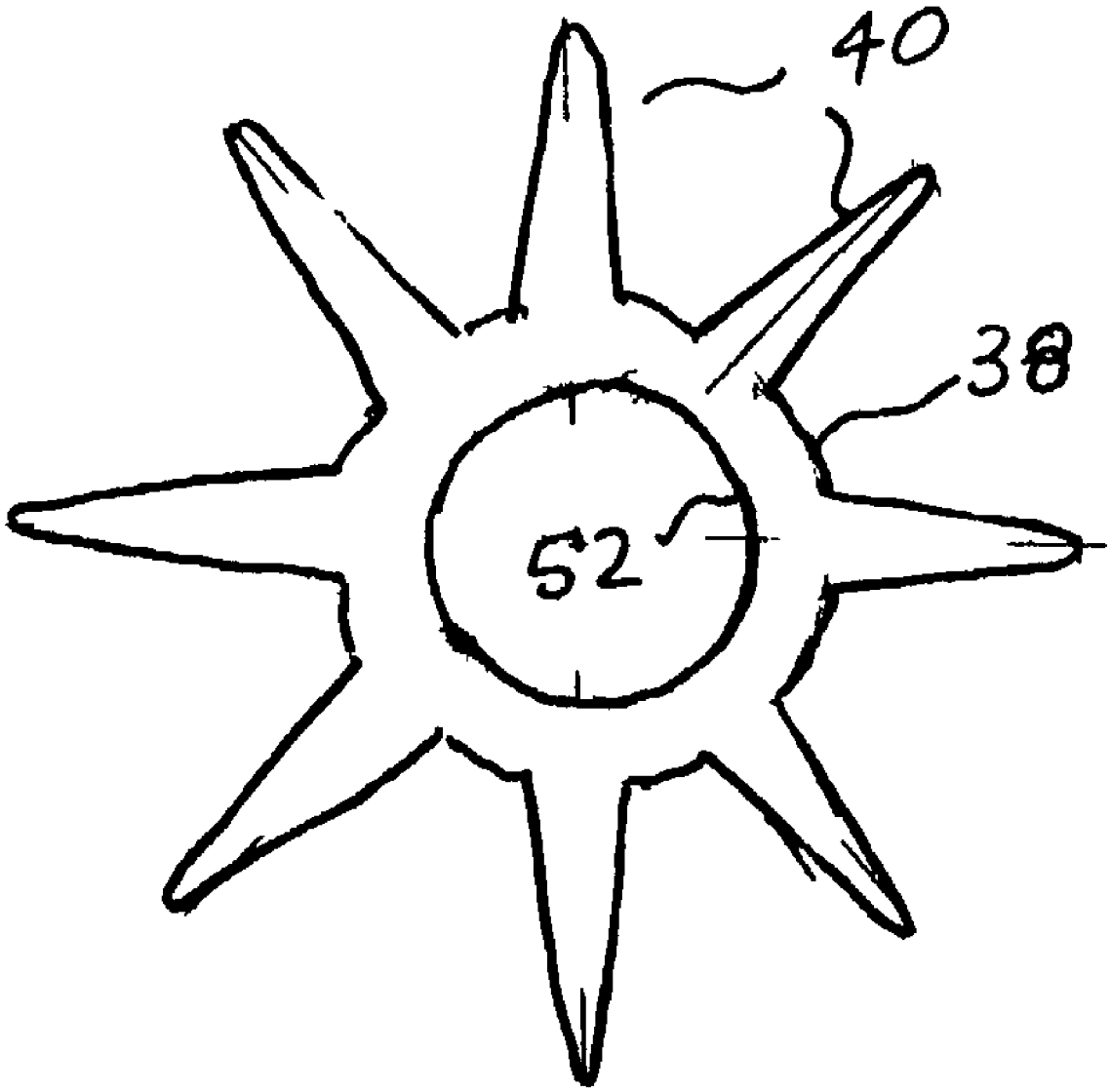
FIG. 7 is a view of an alternate embodiment of the invention.

In another implementation, shown in FIG. 7, the arc of the spine member 38 is a full circle and the fins 40 extend radially from the spine member. If the motor structure requires heat sinking, the radius of the spine member inner edge 52 may be made small enough so that the heat sink contacts the motor structure. If the motor structure does not require heat sinking, the radius of the spine member inner edge 52 may be made large enough so that it does not contact the motor structure and so that it does not heat the motor structure or interfere with heat transfer from the motor structure.

A heat sink according to the invention is advantageous because it can be easily reconfigured for a wide range and variety of heat transfer requirements, while fitting into a small space that would otherwise be unused.

It is evident that those skilled in the art may now make numerous uses of and departures from the specific apparatus and techniques disclosed herein without departing from the inventive concepts. Consequently, the invention is to be construed as embracing each and every novel feature and novel combination of features disclosed herein and limited only by the spirit and scope of the appended claims.

What is claimed is:

1. An acoustic device, comprising:

an acoustic driver, comprising a frustal shaped vibratile surface defining a frustal-shaped volume, said vibratile surface comprising an inner side and an outer side, said frustal-shaped volume characterized by an axis;

a support structure mechanically coupled to said vibratile surface, extending axially from said inner side, defining a second volume, said second volume being contiguous to said frustal-shaped volume, said frustal-shaped volume and said second volume forming an inner volume;

an oscillatory motor device, coupled to said vibratile surface, for causing said vibratile surface to vibrate in an axial direction, causing air movement in said inner volume;

said acoustic device further comprising a heat producing device, distinct from said oscillatory motor device, mounted so that a substantial portion of said heat producing device is in said inner volume.

2. An acoustic device in accordance with claim 1, wherein said heat producing device is an amplifier, for amplifying an audio signal to said acoustic device.

3. An acoustic device in accordance with claim 1, wherein a substantial portion of said oscillatory motor device is in said inner volume.

4. An acoustic device in accordance with claim 1, constructed and arranged to be mounted in a door of a vehicle such that said inner side faces an interior of said vehicle and said outer side faces an exterior of said vehicle and said vibratile surface is between said heat producing device and said vehicle exterior.

5. An acoustic device in accordance with claim 4, wherein said heat producing device is an amplifier for amplifying an audio signal for said acoustic driver.

6. An acoustic device comprising:

an acoustic driver, comprising a frustal-shaped vibratile surface defining a frustal-shaped volume, said vibratile surface comprising an inner side and an outer side, said frustal shaped volume characterized by an axis;

a support structure mechanically coupled to said vibratile surface, extending axially from said inner side, defining a second volume, said second volume being contiguous to said frustal-shaped volume, said frustal shaped volume and said second volume forming an inner volume;

said acoustic device further comprising an oscillatory motor device, coupled to said vibratile surface, for causing said vibratile surface to vibrate in an axial direction, causing air movement in said inner volume;

a heat producing device, distinct from said oscillatory motor device; and a heat sink, thermally coupled to said heat producing device, for transferring heat from said heat producing device, wherein said acoustic driver, said heat producing device and said heat sink are constructed and arranged so that a substantial portion of said heat sink is in said inner volume.

7. An acoustic device in accordance with claim 6, wherein said heat sink and said heat producing device are completely in said inner volume.

8. An acoustic device in accordance with claim 6, said heat sink comprising fins, said fins comprising a plurality of edges, wherein one of said plurality of edges is substantially parallel to said vibratile surface.

9. An acoustic device in accordance with claim 8, said fins comprising first and second opposing planar faces characterized by planes, wherein said planes are substantially perpendicular to said spine member.

10. An acoustic device comprising:

an acoustic driver, comprising a surface defining a volume, the surface comprising an inner side and an outer side in which the inner side is directed inward into the volume and the outer side is directed outward away from the volume;

a support structure coupled to the surface;

the acoustic device further comprising an oscillatory motor device, coupled to the surface, for causing the surface to vibrate, causing air movement in the volume;

a heat producing device, distinct from the oscillatory motor device; and a heat sink, thermally coupled to the heat producing device, for transferring heat from the heat producing device, in which the acoustic driver, the heat producing device and the heat sink are constructed and arranged so that a substantial portion of at least one of the heat producing device or the heat sink is in the volume.

* * * * *